US005713575A

United States Patent [19]

Angelucci

[11] Patent Number: 5,713,575

[45] Date of Patent: Feb. 3, 1998

[54] DISC BOUNCING GAME

[76] Inventor: Armand Angelucci, 205 Standbridge St., Norristown, Pa. 19401

[21] Appl. No.: 771,523

[22] Filed: Dec. 23, 1996

[51] Int. Cl.[6] ..... A63B 63/08

[52] U.S. Cl. ..... 273/317.3; 273/342; 273/402

[58] Field of Search ..... 273/317.3, 342, 273/398, 399, 400, 401, 402, 472

[56] References Cited

U.S. PATENT DOCUMENTS

| | | | |
|---|---|---|---|
| D. 315,185 | 3/1991 | Maloney | D21/201 |
| 1,523,686 | 1/1925 | Davies | 273/317.3 |
| 1,712,073 | 5/1929 | Fowler | 273/317.3 |
| 2,201,560 | 5/1940 | Nelson | 273/317.3 |
| 2,611,615 | 9/1952 | Watson | 273/317.3 |
| 4,175,746 | 11/1979 | McRitchie | 273/317.3 |
| 4,210,328 | 7/1980 | Meintzer | 273/342 X |
| 5,120,053 | 6/1992 | Head et al. | 273/402 |
| 5,123,653 | 6/1992 | Murphy et al. | 273/244 |
| 5,228,691 | 7/1993 | McAlley | 273/317.3 |
| 5,240,259 | 8/1993 | O'Grady | 273/402 |
| 5,423,552 | 6/1995 | English | 273/342 |
| 5,522,598 | 6/1996 | Loyd et al. | 273/402 |

*Primary Examiner*—William H. Gried

[57] ABSTRACT

A new Disc Bouncing Game for simulating a basketball game by awarding of points relative to the bouncing of a disc, such as a coin, through a hoop. The inventive device includes a game board having the simulation of one end of a basketball court, and a backboard and hoop assembly detachably secured to the game board.

9 Claims, 3 Drawing Sheets

DISC BOUNCING GAME

BACKGROUND OF THE INVENTION

1. Field of the Invention

The present invention relates to basketball board games and more particularly pertains to a new Disc Bouncing Game for simulating a basketball game by the awarding of points relative to the bouncing of a disc, such as a coin, through a hoop.

2. Description of the Prior Art

The use of basketball board games is known in the prior art. More specifically, basketball board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art basketball board games include U.S. Pat. Nos. 5,423,552; 4,210,328; Des. 315,185; 4,175,746; 5,228,691 and 5,123,653.

While these devices fulfill their respective, particular objectives and requirements, the aforementioned patents do not disclose a new Disc Bouncing Game. The inventive device includes a game board having a simulation of one end of a basketball court, and a backboard and hoop assembly detachably secured to the game board.

In these respects, the Disc Bouncing Game according to the present invention substantially departs from the conventional concepts and designs of the prior art, and in so doing provides an apparatus primarily developed for the purpose of simulating a basketball game by awarding of points relative to the bouncing of a disc, such as a coin, through a hoop.

SUMMARY OF THE INVENTION

In view of the foregoing disadvantages inherent in the known types of basketball board games now present in the prior art, the present invention provides a new Disc Bouncing Game construction wherein the same can be utilized for simulating a basketball game by awarding of points relative to the bouncing of a disc, such as a coin, through a hoop.

The general purpose of the present invention, which will be described subsequently in greater detail, is to provide a new Disc Bouncing Game apparatus and method which has many of the advantages of the basketball board games mentioned heretofore and many novel features that result in a new Disc Bouncing Game which is not anticipated, rendered obvious, suggested, or even implied by any of the prior art basketball board games, either alone or in any combination thereof.

To attain this, the present invention generally comprises a game board having the simulation of one end of a basketball court, and a backboard and hoop assembly detachably secured to the game board.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Disc Bouncing Game apparatus and method which has many of the advantages of the basketball board games mentioned heretofore and many novel features that result in a new Disc Bouncing Game which is not anticipated, rendered obvious, suggested, or even implied by any of the prior art basketball board games, either alone or in any combination thereof.

It is another object of the present invention to provide a new Disc Bouncing Game which may be easily and efficiently manufactured and marketed.

It is a further object of the present invention to provide a new Disc Bouncing Game which is of a durable and reliable construction.

An even further object of the present invention is to provide a new Disc Bouncing Game which is susceptible of a low cost of manufacture with regard to both materials and labor, and which accordingly is then susceptible of low prices of sale to the consuming public, thereby making such Disc Bouncing Game economically available to the buying public.

Still yet another object of the present invention is to provide a new Disc Bouncing Game which provides in the apparatuses and methods of the prior art some of the advantages thereof, while simultaneously overcoming some of the disadvantages normally associated therewith.

Still another object of the present invention is to provide a new Disc Bouncing Game for simulating a basketball game by awarding of points relative to the bouncing of a disc, such as a coin, through a hoop.

Yet another object of the present invention is to provide a new Disc Bouncing Game which includes a game board having the simulation of one end of a basketball court, and a backboard and hoop assembly detachably secured to the game board.

Still yet another object of the present invention is to provide a new Disc Bouncing Game that is designed in pieces to allow the game to be broken down for easy packaging, shipping, and storage.

Even still another object of the present invention is to provide a new Disc Bouncing Game that is easy to learn yet challenging to master, while providing entertainment and improving hand-eye coordination.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
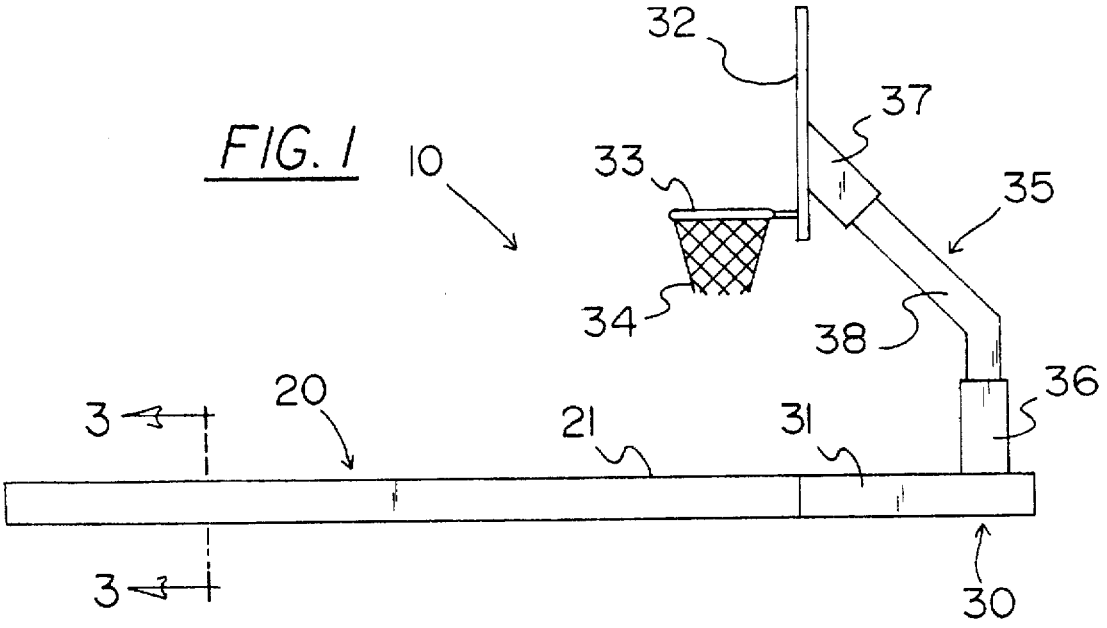
FIG. 1 is a side view of a new Disc Bouncing Game according to the present invention.
Figure 2:
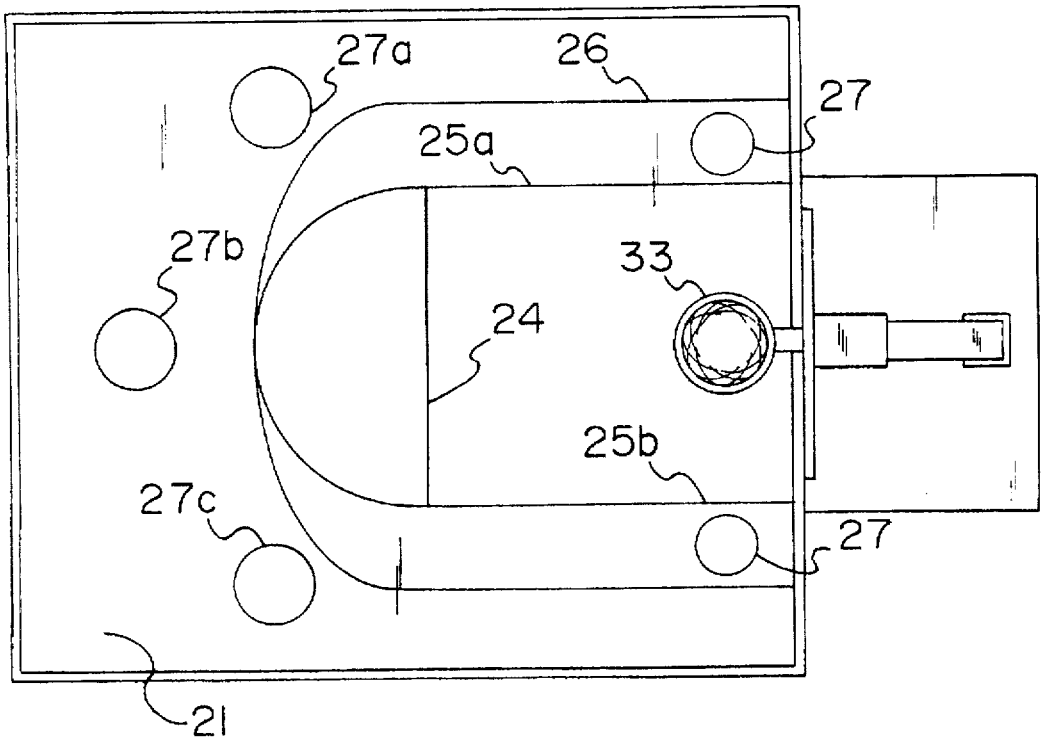
FIG. 2 is a top view thereof.

With reference now to the drawings, and in particular to FIGS. 1 through 6 thereof, a new Disc Bouncing Game embodying the principles and concepts of the present invention and generally designated by the reference numeral 10 will be described.

More specifically, it will be noted that the Disc Bouncing Game 10 comprises a rigid game board 20 and a backboard and hoop assembly 30.

As best illustrated in FIGS. 1 through 6, it can be shown that the game board 20 is substantially rigid and includes a smooth upper surface 21 upon which a player bounces coins, game discs, or other disc-like objects. Although coins are metallic, the discs and disc-like objects could be formed of materials having a similar bounce to metallic coins. If game discs are used, the discs could include a basketball design or a team logo, or both, on the faces of the discs.

Figure 3:
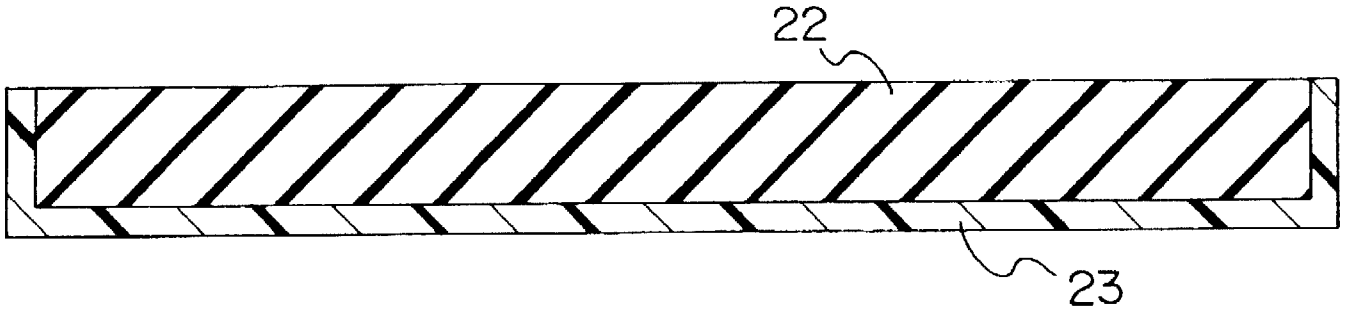
FIG. 3 is a cross-sectional view along lines 3—3 of FIG. 1.
Figure 4:
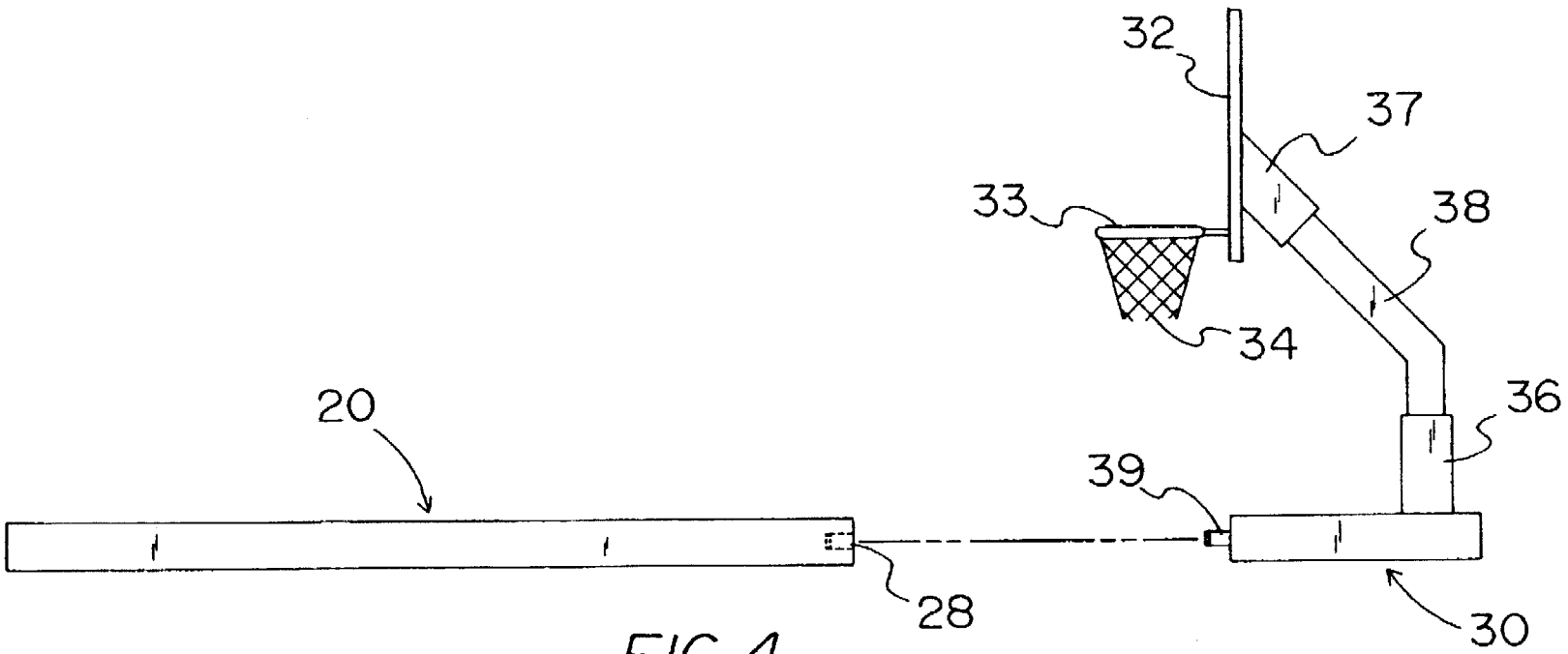
FIG. 4 is a view similar to FIG. 1, but showing the game board and backboard and hoop assembly unattached.
Figure 5:
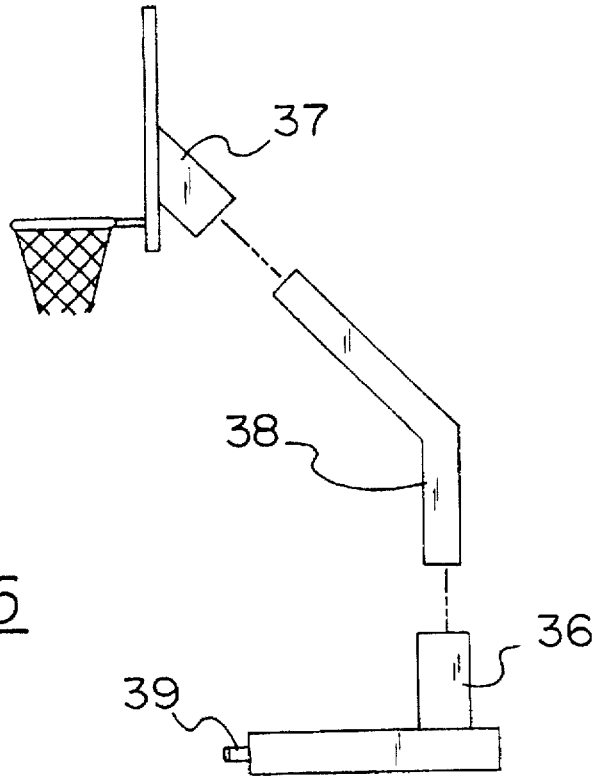
FIG. 5 is a view showing the pieces of the backboard and hoop assembly.
Figure 6:
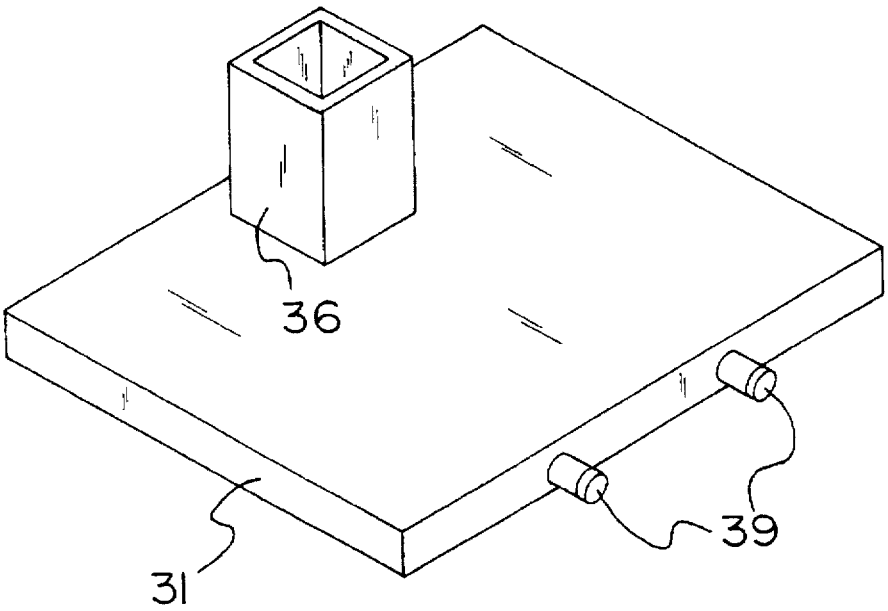
FIG. 6 is a view of the supporting base member.

As seen in FIG. 3, the board 20 is formed of a first part 22 making up the majority of the board, and an outer covering 23. The first part 22 is made of a first material which can be wood, wood products, metal, synthetic or natural polymers, or the like, in order to make the upper surface 21 rigid enough to deflect the disc-like objects. The outer covering 23 is made of a non-rigid plastic, rubber, or the like, in order to prevent scratching of a surface that the board is disposed on and to prevent sliding movements of the board.

Disposed on the upper surface 21 of the board are markings simulating a basketball court. These markings include a free throw line 24, lane lines 25*a*,25*b*, and a "three-point" line 26. Areas 27 are also marked on the upper surface indicating different point zones on the board. The areas 27, and other portions of the upper surface, can include various designs, such as basketball designs or team logos.

The backboard and hoop assembly 30 includes a supporting base member 31, a planar backboard 32 with a hoop 33 attached thereto, and support means 35 extending between the backboard and base member. As shown, the base member has a thickness generally equal to the thickness of the game board, and is detachably secured to the game board. The hoop includes a net-like member 34 attached thereto, and the hoop and backboard could be detachably secured together in order to facilitate packaging and storage. The backboard is disposed generally perpendicular to the game board and can include a square target area disposed above the hoop.

The support means 35 includes a support piece 36 attached to the base member, a support piece 37 attached to the backboard and extending at an angle therefrom, and a dog-leg shaped piece 38 detachably secured to the pieces 36 and 37. The dog-leg shape of piece 38 insures that the hoop 33 is disposed above the game board when assembled. The detachable feature of the pieces 36–38 allows the support means to be broken down, in order to reduce space. It is also contemplated that the piece 36 could be detachably secured to the base member 31, and that the piece 37 could be detachably secured to the backboard 32, in order to further reduce space.

The base member 31 is detachably secured to the game board 20 by dowel pins 39 projecting from an end of the base member, which fit into complementary shaped recesses 28 in an end surface of the game board 20. It is noted that the dowels could be on the game board and the recesses on the base member. It is also possible to utilize other forms of detachable connections, such as a dovetail and groove connection. Assembly and disassembly of the game is considered obvious from the above description, and is therefore not further described.

In use, a player bounces the disc-like object on the rigid upper surface in an attempt to make the object go through the hoop and net. Depending upon where the object is bounced from, different points are awarded with each successful basket. For instance, a basket scored from within the confines of the "three-point" line 26 is awarded one point. A basket scored beyond the line 26 is awarded two points. Some of the areas 27 could be designated as special scoring areas, such as areas 27*a*–27*c*, where a higher number of points, such as three or five, would be awarded if the disc-like object was bounced from that location and scored.

Games could be played to twenty-one as follows: players would take turns bouncing the disc-like objects from various areas on the board to score points. Each turn would comprise two shots. The first shot can be taken from anywhere on the board. If the first shot misses, the second shot would be taken from the free throw line 24. As stated previously, a shot within the line 26 would generate one point. The player shoots until he misses, and then the next player takes his turn. If a player makes the disc-like object go into the hoop and net, but it does not go all the way through, the player is penalized an amount equal to the amount of points from where the shot was taken. The first player to reach twenty-one points is the winner.

Although the game is described as being played to twenty-one, other final scores could be used to determine the winner. In addition, although the game is described as using a point scoring system, the game could be played as a drinking game with the points represented by number of drinks to be taken by the players.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A Disc Bouncing Game utilized by a player comprising:

a generally rigid, flat game board having a smooth tipper surface upon which a disc-like member is bounced by the player thereby producing a trajectory for said member, said game board having a representation of one half of a basketball court marked thereon;

a game board end surface removably attachable to an end edge of the game board to form an extension of said smooth upper surface;

a backboard and hoop assembly detachably secured to the game board end surface by attachment means, said backboard and hoop assembly including a backboard disposed in a plane perpendicular to the upper surface, and a hoop attached to the backboard and disposed over the game board.

2. The Disc Bouncing Game of claim 1, wherein the attachment means comprises at least one male-female type connection.

3. The Disc Bouncing Game of claim 1 wherein the game board end surface is attached to the game board by a projecting member and a complementary shaped recess for receiving the projecting member.

4. The Disc Bouncing Game of claim 3, wherein the projecting member comprises a dowel pin attached to the game board end surface and said recess is formed in the end edge of the game board.

5. The Disc Bouncing Game of claim 1, wherein the assembly further comprises a supporting base member mounted on said game board end surface, and support means extending between the base member and the backboard for attaching the backboard to the base member.

6. The Disc Bouncing Game of claim 5, wherein the support means comprises a plurality of detachably secured pieces.

7. The Disc Bouncing Game of claim 6, wherein one of said pieces is a backboard piece attached to the backboard, another of said pieces is a base member piece attached to the base member, and another of said pieces is a dog-leg shaped piece detachably fastened to the backboard piece and the base member piece.

8. The Disc Bouncing Game of claim 1, wherein the game board includes a resilient outer layer on its end surfaces and bottom.

9. A Disc Bouncing Game utilized by a player comprising:

a generally rigid, flat game board having a smooth upper surface upon which a disc-like member is bounced by the player thereby producing a trajectory for said member and a resilient outer layer on end surfaces and a bottom of the game board;

a game board end surface removably attachable to an end edge of the game board to form an extension of said smooth upper surface, said game board end surface being removably attached by a dowel pin projecting from the game board end surface and fitting within a complementary shaped recess formed within said game board; and a backboard and hoop assembly detachably secured to said game board end surface, said backboard and hoop assembly including a supporting base member, a backboard disposed in a plane perpendicular to the upper surface, support means extending between the base member and the backboard, and a hoop attached to the backboard and disposed over the game board, said support means including a support piece attached to the backboard, a support piece attached to the base member, and a dog-leg shaped support piece detachably fastened to the backboard support piece and the base member support piece.

* * * * *